US006070526A

United States Patent [19]

Larson

[11] Patent Number: 6,070,526

[45] Date of Patent: Jun. 6, 2000

[54] TENSIONING SYSTEM FOR SCREEN PRINTING AND METHOD OF TENSIONING

[76] Inventor: James D. Larson, 6323 83rd Ave. SE., Snohomish, Wash. 98290

[21] Appl. No.: 09/176,780

[22] Filed: Oct. 22, 1998

[51] Int. Cl.[7] ..... B05C 17/08; B41F 15/36

[52] U.S. Cl. ..... 101/129; 38/102.4; 38/102.21; 101/127.1; 160/391; 160/395; 160/403

[58] Field of Search ..... 101/127.1, 128.1, 101/128.21, 129; 38/102.21, 102.4; 160/374.1, 378, 381, 391, 392, 395, 403; 81/180.1

[56] References Cited

U.S. PATENT DOCUMENTS

| | | | |
|---|---|---|---|
| 3,601,912 | 8/1971 | Dubbs | 101/127.1 |
| 3,908,293 | 9/1975 | Newman | 101/127.1 |
| 5,127,176 | 7/1992 | Newman | 101/127.1 |
| 5,443,003 | 8/1995 | Larson | 101/127 |
| 5,488,901 | 2/1996 | Hruska | 101/129 |
| 5,676,052 | 10/1997 | Wegrzyn et al. | 101/127.1 |
| 5,937,753 | 8/1999 | McKeever | 101/127.1 |

*Primary Examiner*—John S. Hilten
*Assistant Examiner*—Leslie J. Grohusky
*Attorney, Agent, or Firm*—Jensen & Puntigam

[57] ABSTRACT

A tensioning system for use in a retensionable frame used in silk screening wherein the fabric is precut and bordered with splines such that the appropriate tension is predetermined. A wrench including indicia to assure proper placement upon the tensioning hex extension is provided with a stop which assures appropriate tension.

10 Claims, 3 Drawing Sheets

FIG. 1
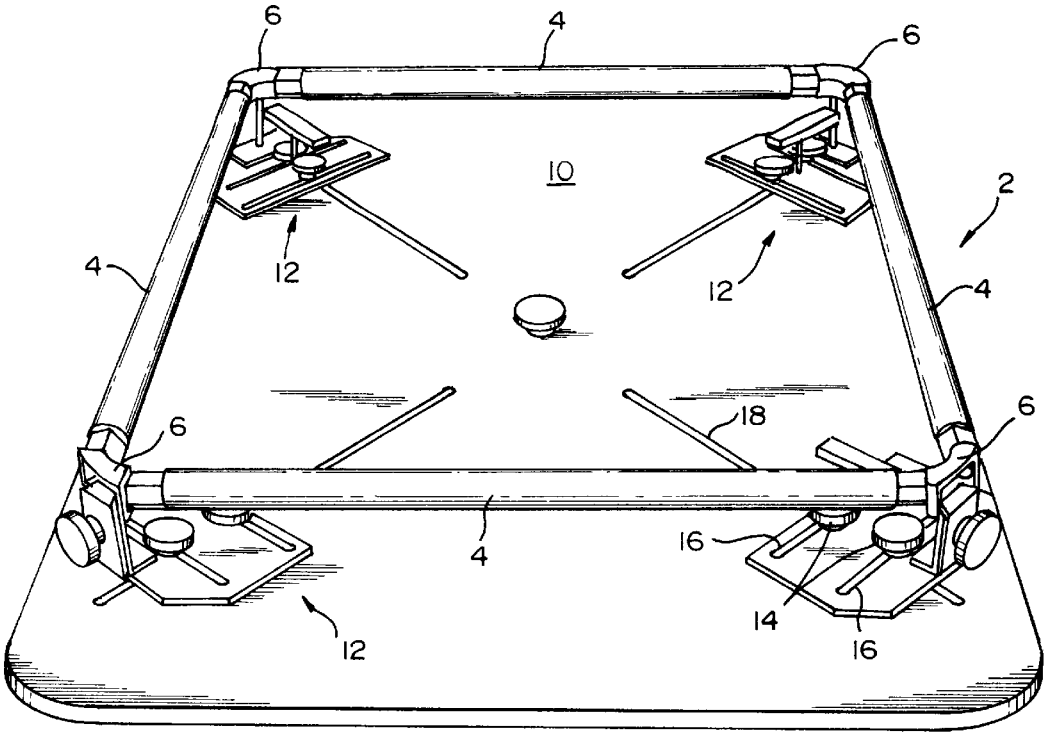
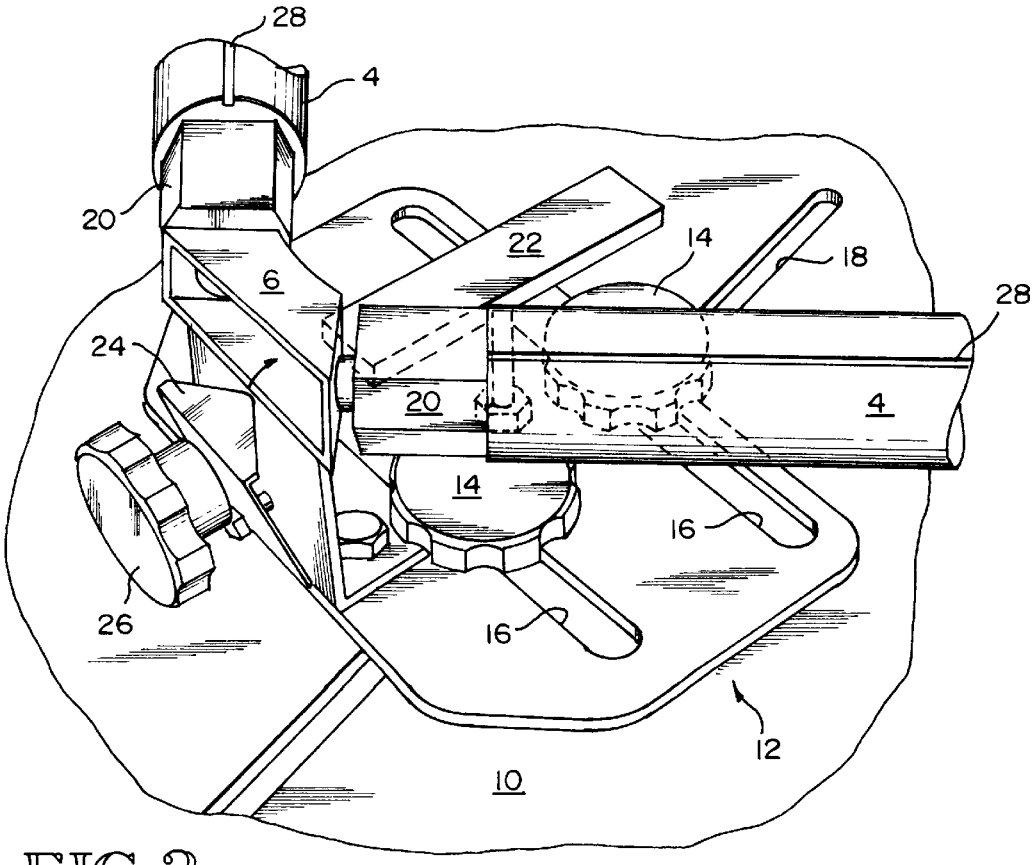
FIG. 2

FIG. 3
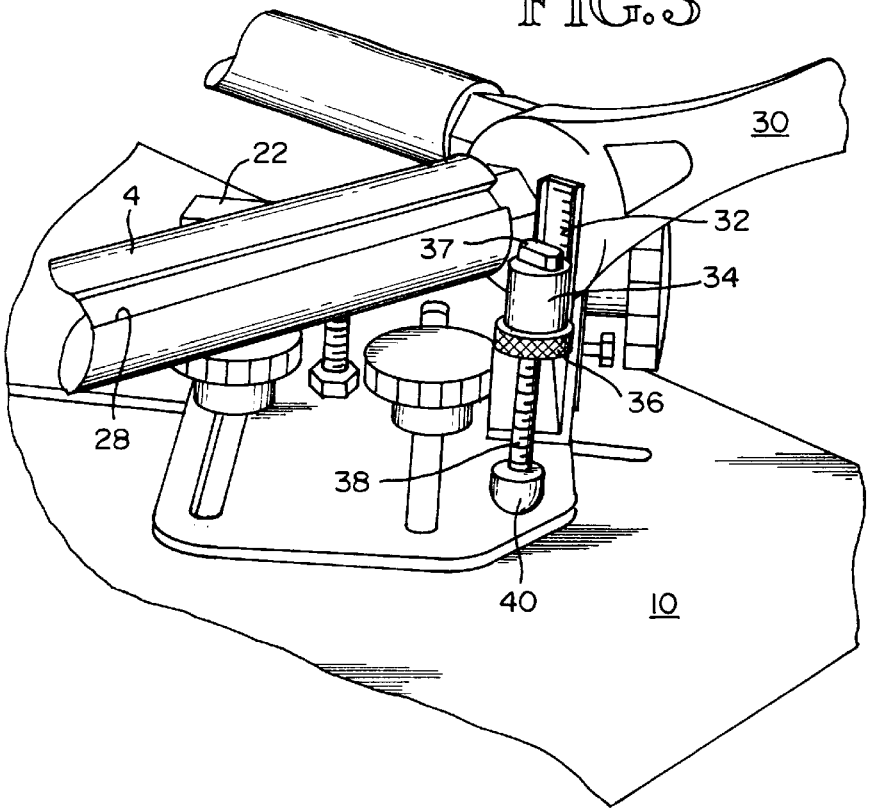
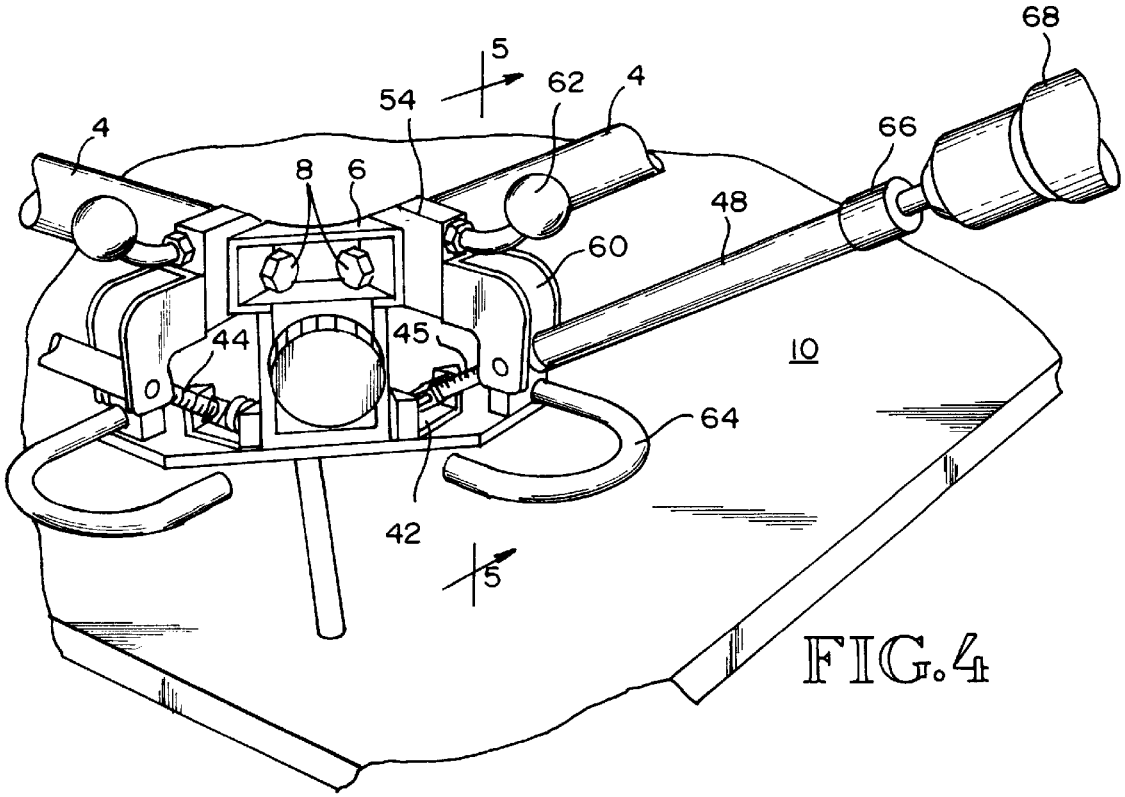
FIG. 4

TENSIONING SYSTEM FOR SCREEN PRINTING AND METHOD OF TENSIONING

TECHNICAL FIELD

This invention relates broadly to the category of tensioning screening material for a silk screen, and more specifically to a system wherein the fabric screen is pre-cut and the roller frame pre-positioned such that when the fabric is secured to the frame, a predetermined rotation of the rollers places the screen at the appropriate tension, and further to utilize a wrench having a preset stop means to prevent under- or overstretching.

BACKGROUND OF THE INVENTION

Historically, stretching the fabric screen and attaching the screen to a frame, achieving the appropriate tension, was a time-consuming job, and success was largely dependent upon the skill of the person involved, in that the stretching was done manually and the screen was then attached to a rigid frame mechanically.

As popularity of silk screen process has grown and the need for reduced cost become apparent, silk screen frames were developed wherein the sides of the rectangular frame were elongated cylinders and the screen was attached to the cylinders, then the cylinders were rotated to achieve the appropriate tension. This method likewise required a certain amount of skill and an expensive instrument (tension meter) to ascertain the proper tension. Industry studies indicated that even though the roller frames were relatively rigid, the higher tension achievable with modern fabrics caused inward deflection; and subsequently, the industry started pretensioning and pre-forming the fabrics with integral framework or splines along the edges of the fabric, such that they could be quickly secured to a roller frame by placing the splines in a slot in the roller and tensioned by rotating the cylindrical sides, achieving an equal tension throughout the screen.

The problem still remained in terms of rotating the frame elements in an exact amount to have the appropriate tension. Hence, the present invention incorporates a preformed screen placed upon a pre-positioned frame element and then rotated a predetermined amount. The predetermined amount of rotation is physically placed upon the wrench element in the form of a physical stop means which prescribes the rotation of the roller.

Patents known to the inventor dealing with the process of stretching a fabric on a frame include U.S. Pat. No. 2,832,171 granted to Batey on Apr. 29, 1958, which utilizes two adjacent rollers in a rectangular frame which are interlinked and torqued to create tension on a fabric for a rug; U.S. Pat. No. 4,525,909 granted to Newman on Jul. 2, 1985, which deals with a roller frame which surrounds a rigid frame and allows for tensioning four sides of a rectangle to place the appropriate tension upon a silk screen; and U.S. Pat. No. 5,018,442 granted to Hamu on May 28, 1991, which discloses an improvement upon the Newman patent '909 by eliminating the rigid support frame.

Patents which deal primarily with pre-forming or pre-bordering the fabric for placing upon a frame for further tensioning include: U.S. Pat. No. 5,274,934 granted to Newman, Jr. on Jan. 4, 1994, which includes strips adapted to be secured to either a fixed rectangular frame in predetermined positions or upon a roller frame for tensioning the fabric; U.S. Pat. No. 5,390,596 granted to Farr on Feb. 21, 1995, which discloses a rectangular frame which is designed so that one corner may be moved out of the plane used for screening, shortening the distance spanning the corners, then allowing the fabric to be placed on and the frame returned to its rectangular position, tensioning the fabric; U.S. Pat. No. 5,443,003 granted to Larson on Aug. 22, 1995, which discloses trimming the fabric to the configuration it will assume when under tension, placing strips or splines around the edges of the pre-cut fabric, and then snapping the fabric into place in pre-formed grooves in the roller for tensioning the fabric; and U.S. Pat. No. 5,522,314 granted to Newman, Jr. on Jun. 4, 1996, which discloses another method of accurately positioning border strips on the fabric for predetermining the appropriate position.

In addition, U.S. Pat. No. 5,488,901 granted to Hruska on Feb. 6, 1996 discloses a structure for supporting a silk screening frame and a means for placing the appropriate tension thereon.

SUMMARY OF THE INVENTION

With the above-noted prior art in mind, it is an object of the present invention to provide a screen tensioning system for use in conjunction with a pre-cut screen panel, such that when the roller frame is securely clamped into a support element, the panel can be attached to the roller element and the roller element torqued to a predetermined amount to assure that the panel is firstly at the correct tension, and secondly preventing the panel from being torn.

It is another object of the present invention to provide a tool for torquing the roller elements of the roller frame used in silk screening to the point that the screen in place assumes the proper tension.

It is a further object of the present invention to provide a tool for use in tensioning a silk screen fabric, wherein the tool includes an integral stop means whereby once the tool is pre-set to the appropriate stop means determined by the characteristics of the fabric being tensioned, the appropriate tension is clearly ensured.

It is still a further object of the present invention is to provide a silk screen tensioning device wherein the roller frame is clamped to a table and the clamps on at least three corners include an integral wrench-like tool, including integral stop means which can be set for a predetermined tension desired, and then the tool rotated to the stop, resulting in the appropriate tension upon the fabric.

BRIEF DESCRIPTION OF THE DRAWINGS

FIG. 1 is an environmental view showing a roller screening frame mounted at each corner to a mounting means which is in turn secured to a turntable including adjusting means to accommodate different frame sizes.

FIG. 2 is an enlarged view of one of the mounting means of FIG. 1.

FIG. 3 is a corner view, further disclosing an open-end wrench having a physical stop means to prevent over-rotation.

FIG. 4 is another view of the clamping means of FIGS. 1 and 2, wherein an integral wrench means to accommodate the tensioning including a stop means is shown.

BEST MODE FOR CARRYING OUT THE INVENTION

Figure 5:
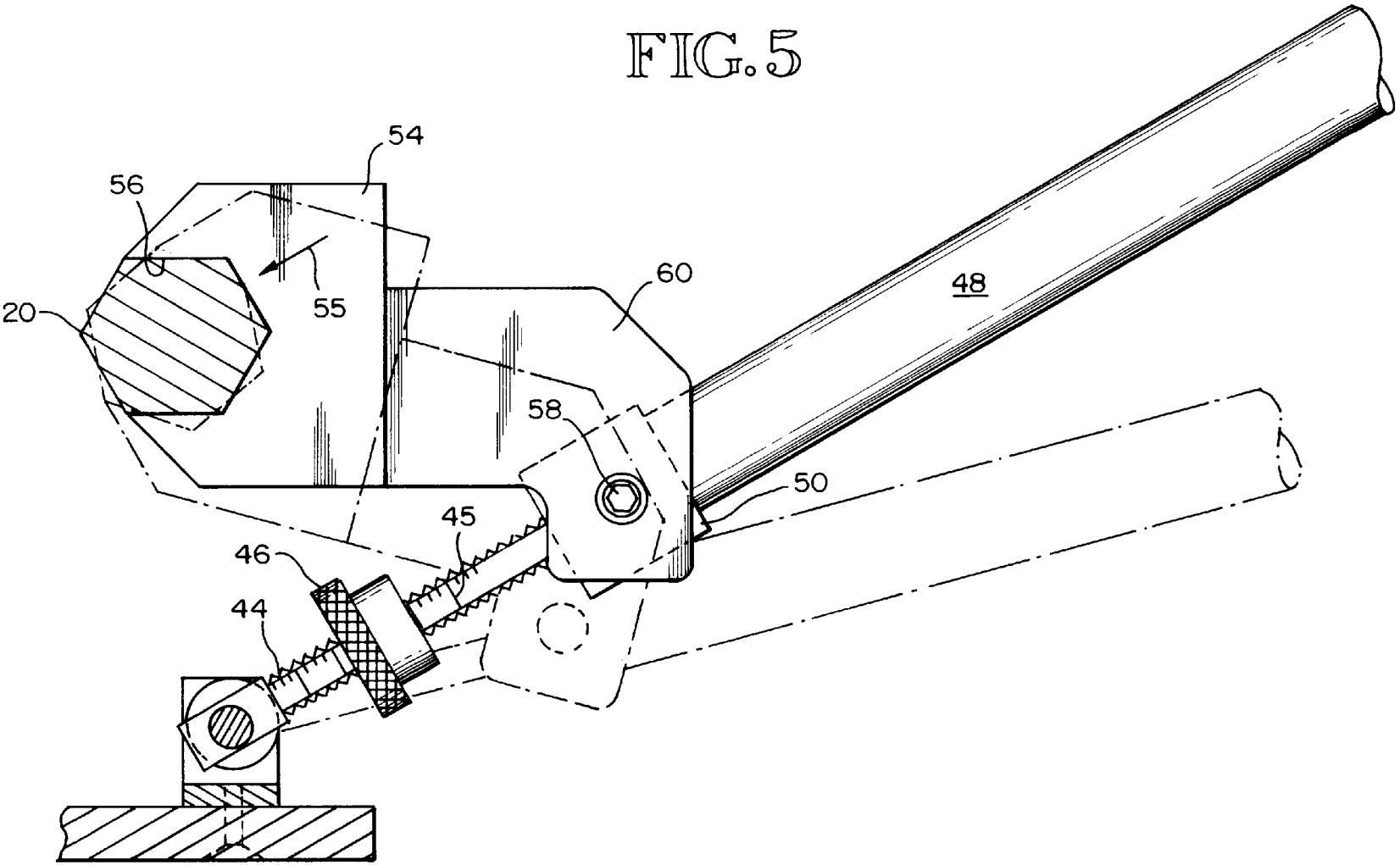
FIG. 5 is a section along lines 5—5 of FIG. 4.

Referring to FIG. 1, there can be seen a rectangular silk screen frame 2 including four sides 4 which are selectively rotatable about their axis and joined by corner members 6, each of which include a lock nut 8 at each end of each of the roller frame members 4 to retain them in position when desired (see FIG. 4), i.e. the screen is at proper tension. The frame 2 is mounted on a turntable 10, utilizing a mounting member 12 at each corner. The mounting members 12 are secured through slots 16 and incorporate tightening handles 14 which extend through a slot 18 in the turntable 10, allowing the device to be adjusted to different sized frames and secured in place.

Referring now to FIG. 2, it can be seen that the ends of each the roller sides 4 include at least one set of opposing parallel flats and preferably a hexagonal shaped extension 20 such that the roller frame may be rotated by a wrench to tighten the fabric. Also seen in this view is a shelf or skid plate 22 on which the frame rests prior to and during the clamping process. The frame is clamped to the mounting member 12 by means of a clamping element 24 which is pivoted into the opening in the corner 6 and secure in the clamping position by a handle 26 which is threadingly mounted to a rigid arm, not shown.

In actual operation, a screen such as that produced in accordance with U.S. Pat. No. 5,443,003 including information with respect to the amount of tension which would be appropriate, has been placed on the frame member with the splines or edges within the grooves 28 of the roller elements 4 when groove 28 is in its uppermost position. The operator then places a manual wrench on the hex at the end of the roller and applies torque to the roller achieving the proper tension in the screen which has been appropriately secured to the roller. The roller is then locked in place with nut 8.

As seen in FIG. 3, the manual wrench 30 has mounted thereon a scale or index 32 and an internally threaded sleeve 34 and a finger nut 36, as well as a threaded element 38 which is set further into sleeve 34 and carries nut 36. Threaded element 38 terminates at its lower portion in a bumper 40, to prevent any further torque or movement by wrench 30. When a screen is selected, as noted hereinabove, it has encoded thereon the information accompanying the screen a number which correlates with the index 32. The rod 38 is rotated within sleeve 34 until the upper portion 37 is opposite the appropriate indicia, and then the rod is locked in place with finger nut 36, thus assuring that when the operator torques the sides of the frame to create the tension, the stop will ensure that the appropriate tension is placed upon the screen without the necessity of a tension meter. Further, there is very little chance of making a mistake, as the operator rotates the screen on the turntable to torque each corner in turn. It is understood that once the appropriate torque is achieved, then the member and the appropriate screen element are locked in placed by tightening the lock nuts 8 (see FIG. 4).

Reference is now had to FIGS. 4 and 5, wherein a semi-automatic means of tensioning the screen is shown. The turntable and frame support mechanisms as well as the frame remain the same. However, a lower bracket element 42 has been added to the torque plate to which is pivotally secured an all-thread 44 which has pivotally mounted thereon a finger nut 46 and cylinder 48. At the lower end of cylinder 48 is a bushing and a tubular slide member 50 (see FIG. 5). Slide member 50 has pivotally mounted thereon a wrench having a wrench head 54, including jaws 56 which engage the hexagonal portion at the end of the roller member. The wrench head 54 includes an arrow 55 or other indicia which when aligned with the longitudinal slot 28 or other indicia on the roller member assures that the fabric will be properly tensioned when used in conjunction with the stop member and indicia on the all-thread. The head 54 is pivotally joined to the slide 50 as at pivot-point 58 and is offset through the tensioning member 60, for reasons to be described hereinafter. Also to be seen in FIG. 4 is a handle member 62 to assist in placing the wrench head 54 in position and a hook-like element 64 for supporting the cylinder 48 when not in use. The outer end of the all-thread 44 includes a thread such that a socket 66 attached to a manual wrench or to a variable speed motor 68 may be used to apply the appropriate tension. As has been described with respect to FIG. 3, the all-thread likewise has an indicia 45 thereon such that the finger nut 46 placed at the appropriate position and the continually threaded cylinder 48 is into contact with the finger nut, causing the entire mechanism to move to the phantom position, causing the wrench to rotate about point 58, creating torque upon the roller frame element.

As can be seen, the present invention provides a system of tensioning silk screen which is quick, easy and essentially infallible.

What is claimed is:

1. A silk screen tensioning system, comprising:

a substantially uniplanar support means;

clamping means to receive and secure corners of a rectangular roller frame; and wrench means, including adjustable mechanical stop means for limiting the maximum movement of the wrench means to provide a predetermined tension upon a fabric secured to the roller frame.

2. A system as in claim 1, wherein the wrench means is a hand held removable wrench, and the adjustable stop means includes an adjustable stop which contacts the support means.

3. A system as in claim 2, wherein the adjustable stop comprises an indicia containing element pivotably secured to the wrench and a rigid stop means moveable along said indicia when contacting the support means to prevent further movement of the wrench.

4. A system as in claim 1, wherein the wrench means includes a first elongated threaded element having its interior end pivotally secured to the clamping means, said threaded element including indicia thereon, a second elongated interiorly threaded sleeve member mated to said elongated threaded element for selective movement therealong, and including a hexagonal outer end, and a third element including a head including an outwardly open wrench face adjacent the interior end of the threaded element and a laterally offset portion pivotally secured to the second elongated sleeve element such that when the open wrench face is engaged with the frame, rotation of the threaded sleeve generates a proportional rotation of the frame.

5. A silk screen tensioning system, comprising:

a roller frame including at least three sides which are rotatable about their axes and include an axial slot to receive the silk screen and at least two opposing flats at opposite ends thereof;

whereby a pre-cut and splined screen may be snapped into the slots, said screen because of its mesh count and size predetermining the amount of tension to be placed thereupon; and removable wrench means engageable with the flats to create the tension, said wrench means including adjustable stop means to assure appropriate tension.

6. A method of tensioning silk screens, comprising the steps of:

(a) clamping a rectangular roller frame having at least three elongated sides which are rotatable about their axes and each side having an axial slot on the exterior surface to a suitable uniplanar work surface, said at least three sides including parallel flats at the ends thereof;

(b) placing all of the slots facing upward;

(c) snapping a pre-cut and bordered screen into the slots;

(d) rotating the sides 90° outward;

(e) setting an adjustable stop on a wrench to the position determined by the characteristics of the fabric inserted in step (d); and (f) placing the wrench upon the flats and rotating the roller until the adjustable stop prevents further rotation, thus assuring appropriate and consistent tension every time.

7. A silk screen tensioning system for a rectangular roller frame, comprising:

a substantially uniplanar support means;

adjustable locating means to support each corner of the roller frame; and wrench means interactive with the roller frame and the support means to place tension upon a silk screen mounted upon the roller frame, said wrench means including indexed stop positions to assure predetermined tension on the screen and being removable from said roller frame.

8. A method of tensioning silk screens, comprising the steps of:

(a) locating a rectangular roller frame, having at least three elongated sides which are rotatable about their axes and each side having an axial slot on the exterior surface, upon a suitable uniplanar work surface, said at least three elongated sides including parallel flats at the ends thereof;

(b) placing all of the slots facing upward;

(c) snapping a pre-cut bordered screen into the slots;

(d) adjusting stop means on a wrench means to a predetermined position located by indicia based upon the characteristics of the screen inserted in step (c); and (e) placing the wrench means upon the flats of the elongated side means and rotating the elongated sides until prevented by the stop means, assuring consistent tension.

9. A method as in claim 8, wherein the pre-cut bordered screen includes the appropriate indicia for adjusting the stop means in step (d).

10. A method as in claim 8, including the step of adjusting clamping means on the work surface to accommodate the size of the roller screen.

* * * * *